US006474051B1

(12) United States Patent
Hannen et al.

(10) Patent No.: US 6,474,051 B1
(45) Date of Patent: Nov. 5, 2002

(54) APPARATUS FOR WRAPPING A STACKED-GOODS UNIT WITH A SHRINK-FOIL WRAP

(75) Inventors: Reiner Hannen, Kalkar (DE); Norbert Vermeulen, Kleve (DE)

(73) Assignee: MSK-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

(21) Appl. No.: 09/507,758

(22) Filed: Feb. 18, 2000

(30) Foreign Application Priority Data

Feb. 19, 1999 (DE) ..... 299 02 910 U

(51) Int. Cl.[7] ..... B65B 11/00
(52) U.S. Cl. ..... 53/586; 53/556
(58) Field of Search ..... 53/556, 557, 228, 53/586

(56) References Cited

U.S. PATENT DOCUMENTS

| | | | | |
|---|---|---|---|---|
| 3,729,894 A | | 5/1973 | Stohlquist | |
| 4,413,463 A | * | 11/1983 | Lancaster | 53/399 |
| 4,628,668 A | * | 12/1986 | Wildmoser | 53/399 |
| 4,720,321 A | | 1/1988 | Smith | |
| 4,782,648 A | * | 11/1988 | Van Ottele | 53/553 |
| 4,831,812 A | * | 5/1989 | Cocher et al. | 53/399 |
| 4,914,892 A | * | 4/1990 | Saito et al. | 53/399 |
| 5,054,263 A | * | 10/1991 | Make-Rahkola et al. | 53/399 |
| 5,216,871 A | | 6/1993 | Hannen | |
| 5,351,461 A | * | 10/1994 | Fandard et al. | 53/157 |

FOREIGN PATENT DOCUMENTS

| | | | | |
|---|---|---|---|---|
| DE | 2321457 | * | 1/1974 | |
| EP | 0 183 676 | | 6/1986 | |
| JP | 06191520 A | * | 7/1994 | 53/553 |

* cited by examiner

*Primary Examiner*—Stephen F. Gerrity
*Assistant Examiner*—Thanh K. Truong
(74) *Attorney, Agent, or Firm*—Herbert Dubno

(57) ABSTRACT

An apparatus for wrapping a stacked-good unit with a shrink-foil wrap with a frame forming a portal, with a conveyor extending through this portal for the stacked-good unit, with drivable shrink-foil rolls whose foil webs are connected together at their ends and form a shrink-foil curtain in the portal and double-weld beams movable opposite one another and arranged on both sides of the portal. To facilitate replacement of the shrink-foil webs, the axes of the shrink-foil rolls extend horizontally and rerouting devices are provided for the coil webs running to the curtain from the shrink foil rolls.

14 Claims, 9 Drawing Sheets

9
10
11
B
12
12
13
14
15
16
17

APPARATUS FOR WRAPPING A STACKED-GOODS UNIT WITH A SHRINK-FOIL WRAP

FIELD OF THE INVENTION

Our present invention relates to an apparatus for wrapping a stacked-goods unit with a shrink-foil wrap having a frame forming a portal, a conveyor extending through the portal for the stacked-goods units, drivable shrink-foil rolls whose foil webs are connected together at their ends and form in the portal a shrink-foil curtain, and double-weld beams arranged on both sides of the portal and movable toward one another.

BACKGROUND OF THE INVENTION

In the usual shrink wrapping apparatus, the stacked-goods unit is displaced via the conveyor, which can be a roller conveyor or a chain conveyor or can be comprised of traverses, into the shrink-foil curtain. By feeding the stacked-goods unit into the shrink-foil curtain, the stacked-goods unit is wrapped on three sides with foil. Thereafter, the double-weld beams are displaced along the right and left sides perpendicularly to the conveyor and guide the shrink foil curtain onto the rear fourth side of the stacked-goods unit and meet in the middle of the latter. There the shrink-foil curtain is provided with a double-weld seam which is separated by a heated wire in the middle of the double-weld seam so that ahead of the following stacked-goods unit a further shrink-foil curtain is formed. The double-weld beam can be provided with a weld seam cooling for high cycling rates of the apparatus.

In addition, clamping devices can be provided on the double-weld beams which serve to prevent the weld seam from being strained during the welding and cooling phases by the stretched shrink-foil curtain.

The known apparatuses for the described purposes have shrink-foil roll axes which extend vertically. Since the shrink-foil rolls as a rule are oriented horizontally when they are brought to the apparatus by a fork-lift vehicle or a manually operated lift truck, they must be tilted through 90° before they can be set in place in the apparatus.

This means a significant expense and is not without dangers. In addition, the drives for the shrink-foil rolls engage at their axes. As a consequence, the speeds of the drives must be matched to the decreasing circumference of the shrink-foil rolls by expensive electronic controls.

OBJECT OF THE INVENTION

It is an object of the invention to simplify the replacement of shrink-foil rolls.

Another object of this invention is to provide a shrink-foil wrapping apparatus which is free from the drawbacks of earlier systems as described above.

It is another object of this invention to provide a shrink-wrapping apparatus which can be more rapidly loaded with the rolls of shrink-foil wrap and is nevertheless compact, easily maintained and easily operated.

A further object of this invention is to provide a shrink-foil wrapping apparatus which is more versatile than earlier apparatus, can accommodate stacked or palletized units of different heights and can wrap the units with webs of different widths.

SUMMARY OF THE INVENTION

These objects and others which will become apparent hereinafter are attained, in accordance with the invention, in an apparatus for the shrink wrapping of stacked or palletized goods units which comprises:

a wrapping station formed with a portal;

a conveyor extending through the portal for carrying a succession of stacked-goods units to be wrapped through the portal;

mounting means at each side of the portal for holding a respective roll of a shrink-foil wrap in a horizontal orientation and journaling the respective roll on a respective horizontal axis;

means for driving each of the rolls about the respective axis;

rerouting means at each side of the portal for drawing a respective web of shrink-foil wrap from each roll and orienting the respective web in a vertical plane; and a pair of double-weld beams engaging the webs from each of the rerouting means and welding the webs together to form a shrink-wrap curtain across the portal ahead of a stacked-goods unit displaced along the conveyor, the double-weld beams drawing the webs together behind the stacked-goods unit to form a seam and produce another curtain ahead of a successive stacked-goods unit.

It is important to the invention, as will be described in greater detail below, that the rolls of the foil wrap are mounted horizontally and preferably parallel to the conveyor and perpendicular to the plane of the portal so that the rolls can be loaded into the respective mounting means from the respective sides of the apparatus utilizing conventional fork-lift trucks and the like. The rerouting means can include at least one roller which is inclined to the horizontal and to the vertical and, if desired, a plurality of other rollers around which the web can be looped, including at least one dancer roller per rerouting means.

In the invention, therefore, the axes of the shrink-foil rolls extend horizontally and rerouting devices are provided for the foil webs which are paid off from the shrink-foil rolls to the shrink-foil curtain. Upon replacement of the shrink-foil rolls, a shrink-foil roll can be supplied with the aid of a fork lift or manual-lift truck so that, like they would be supplied on a pallet, they can be laid in the apparatus. This reduces the handling cost and the danger of accidents in replacement of the shrink-foil rolls.

It is advantageous in this regard for journals for the axes of the shrink-foil rolls to be arranged on the outer sides of the frame.

According to the invention, at least a further pair of drivable shrink-foil rolls can be provided whose foil webs can be connected with one another at their ends and form a further shrink-foil curtain in the portal. The axes of these further shrink-foil rolls extend horizontally and rerouting devices are provided for the foil webs running from these shrink-foil rolls to the shrink-foil curtain. The respective rerouting devices of at least one pair of drivable shrink-foil rolls are arranged for upward movement of the foil webs and the further shrink-foil curtain can be height-adjustable or at least a further pair of drivable shrink-foil rolls is provided whose foil webs can be connected together at their ends and form in a portal a further shrink-foil curtain.

The rerouting devices can be arranged for upward swinging of the foil webs and the further shrink-foil curtain about an axis arranged orthogonally to the fastening axes of the rerouting devices.

There is also the possibility of arranging on at least one side of the frame, a multiplicity of shrink-foil rolls, one above the other. Then one of the shrink-foil rolls can serve as a supply roll which is brought into operation when another of the shrink-foil rolls is consumed.

As a result, the downtime in foil replacement is reduced. One can, however, also provide shrink-foil rolls of different foil widths which can be utilized as need dictates.

To reduce the spatial requirements, the shrink-foil rolls can be arranged to be one sided. In this case, the foil web for the one side of the shrink-foil curtain is displaced over the apparatus or under it.

The foil webs can, in addition, be appropriately guided or swung so that they form a shrink-foil curtain with a height which is greater by, for example, 1.5 times, thereby enabling the wrapping of stacked-goods units whose heights are greater than the height of an individual foil web.

In a preferred embodiment of the invention, each shrink-foil roll is juxtaposed with a friction wheel drive engaging at its circumference, and a foil storage is provided for the foil web on its path to the shrink-foil curtain.

This allows electronic control of the speed of the drive to match the decreasing circumference of the shrink-foil roll resulting from foil consumption. The speed of the drive is also no longer dependent upon the cycling rate of the apparatus or the transport speed of the stacked-goods units since the foil storage can be filled continuously and imparted as need arises. The foil storage is sufficient if it includes at least one dancer roller.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
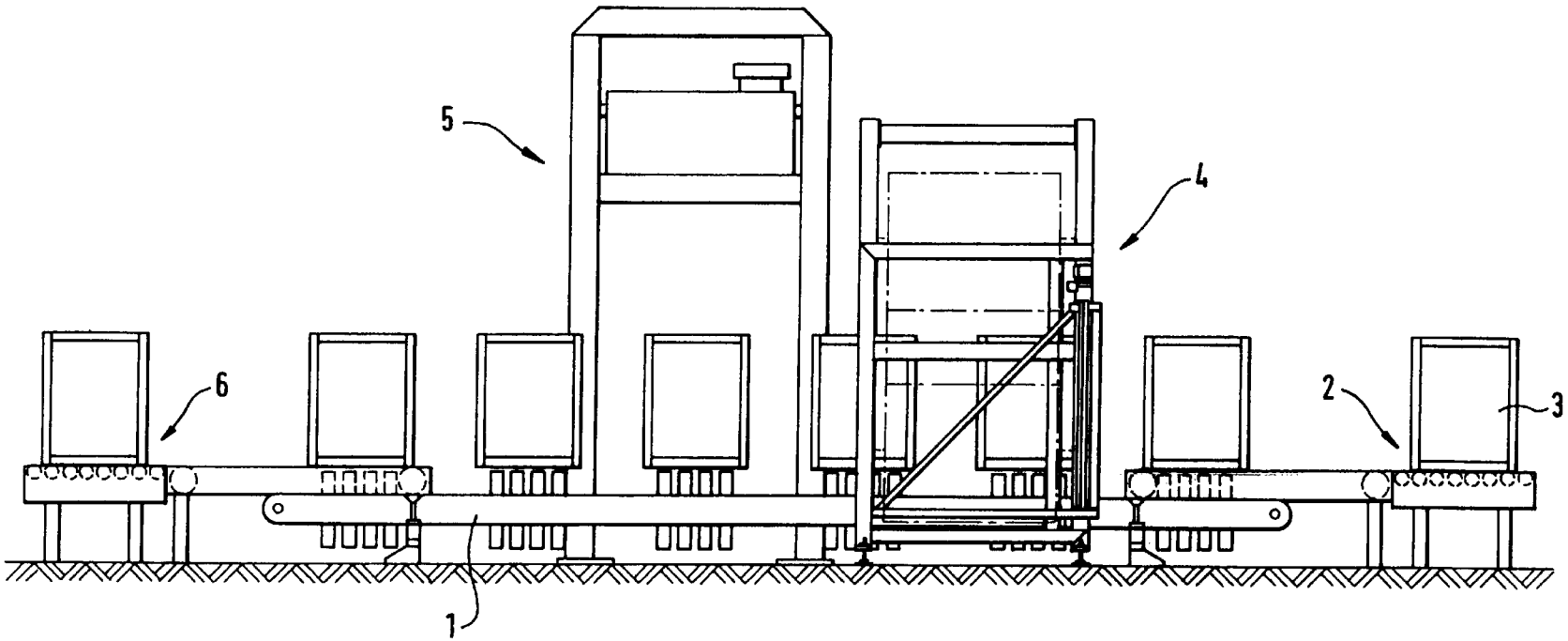
FIG. 1 is a schematic side view of an apparatus for wrapping a stacked-goods unit with a shrink-foil wrap which is subsequently shrunk.
Figure 2:
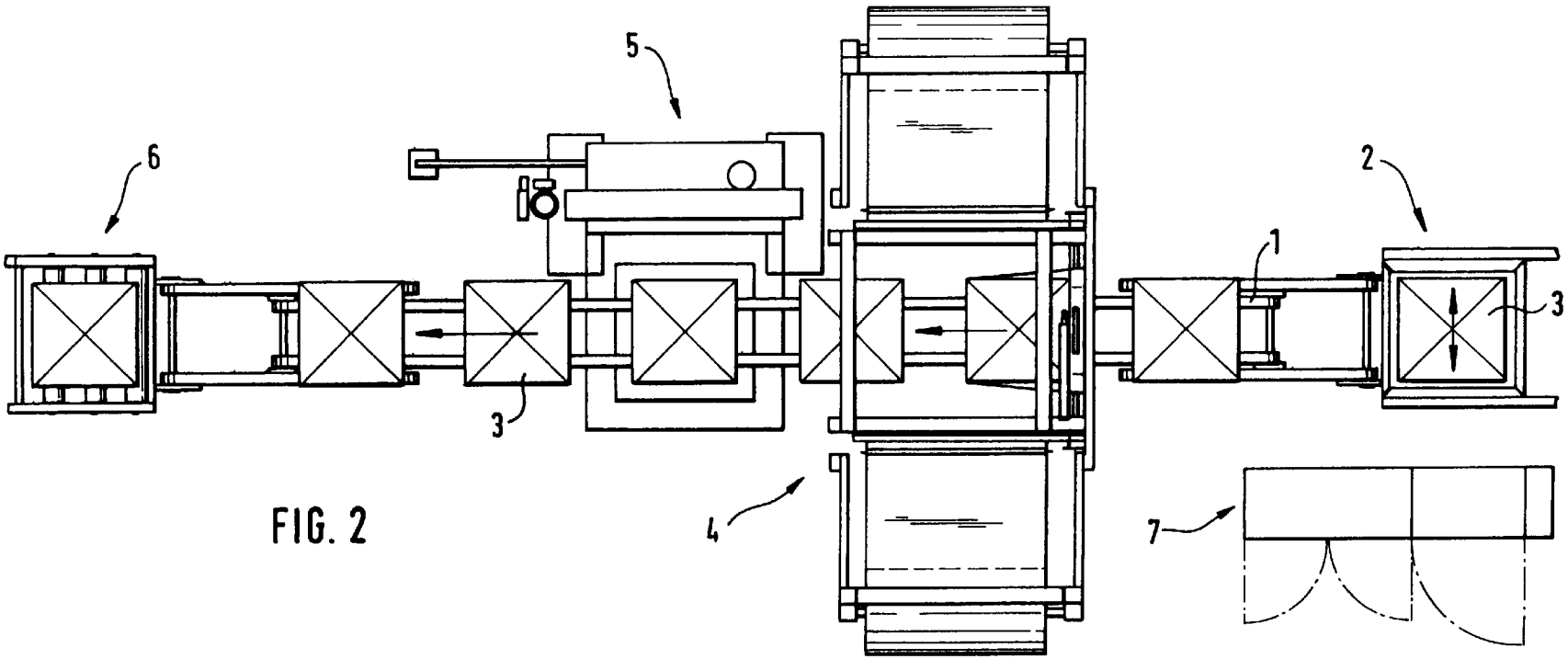
FIG. 2 is a plan view of the subject matter of FIG. 1.

In FIGS. 1 and 2 one can see a conveyor 1 with a receiving end 2 for receiving stacked-good units 3 which can be comprised, especially, of palletized stacks of goods. The conveyor 1 extends through an apparatus 4 for wrapping the stacked-goods unit 3 with a shrink-foil wrap and further through a shrink machine 5 of conventional construction up to a discharge end 6. In the region of the receiving end 2, there is provided a circuitry closet 7.

The apparatus 4 for wrapping includes, as is visible from FIGS. 3 through 9, a frame 9 which forms a portal 8 through which the partly not shown conveyor 1 extends. On exterior sides of the frame 9, journals 10, 10*a* for rotatably supporting the shrink-foil rolls having not been shown in FIGS. 4 and 7 for clarity of the drawing. In the embodiment shown in the FIGURES, on each side of the frame 9 a respective two shrink-foil rolls 11, 11*a* with horizontally extending axes are arranged.

Figure 3:
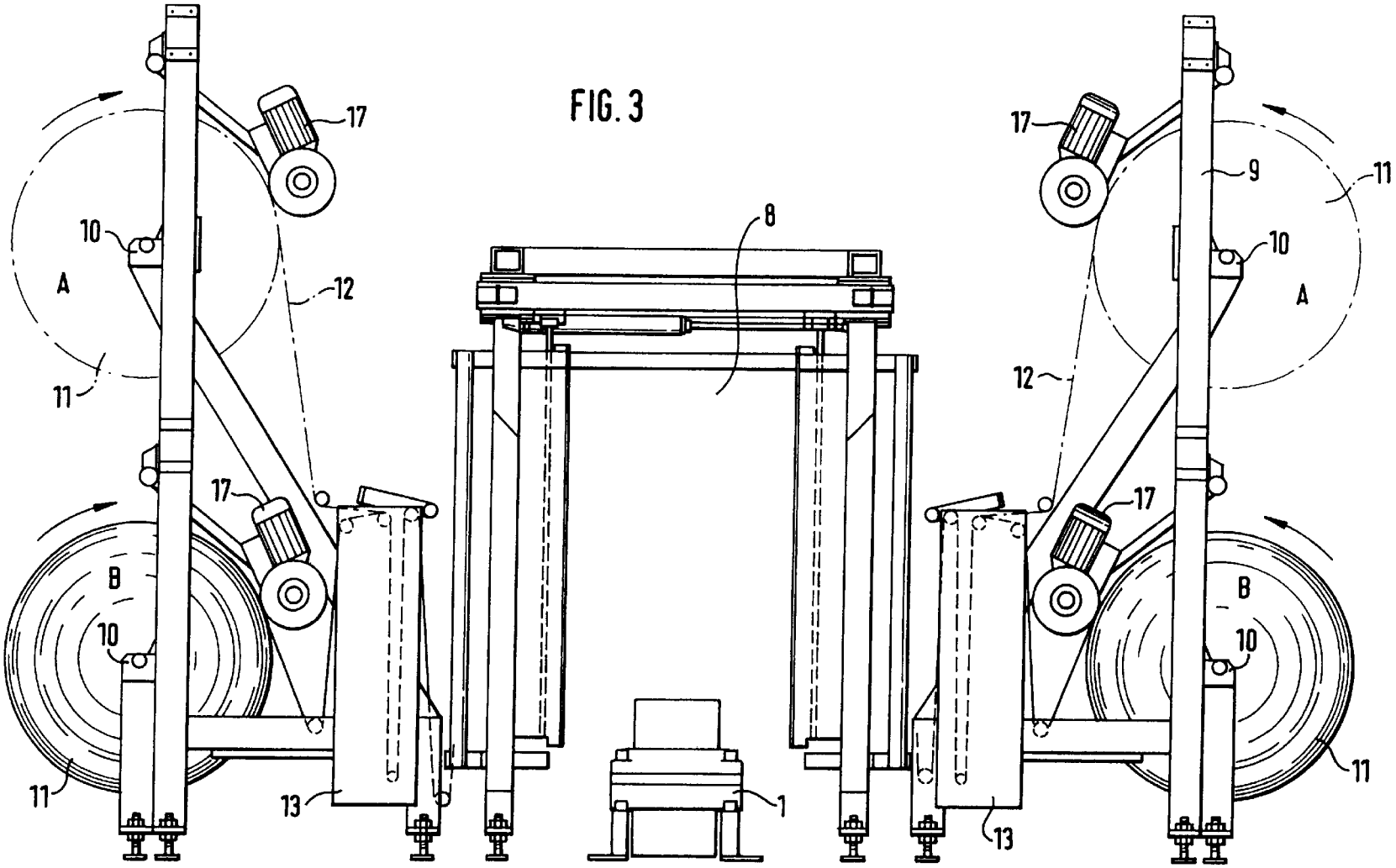
FIG. 3 is an elevational view of an apparatus for wrapping a stacked-good unit with a shrink-foil wrap.
Figure 4:
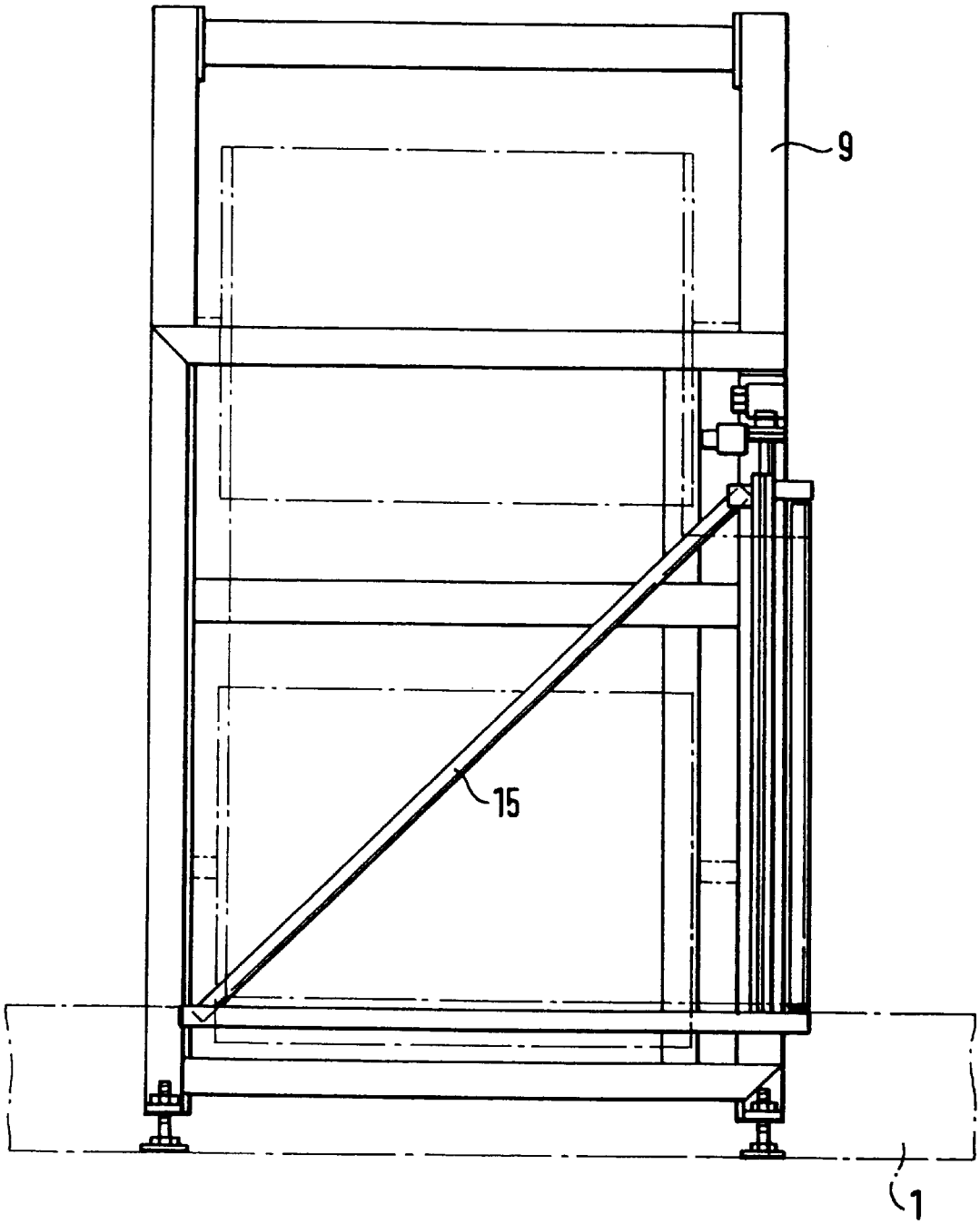
FIG. 4 is a side elevational view of the subject matter of FIG. 3.
Figure 5:
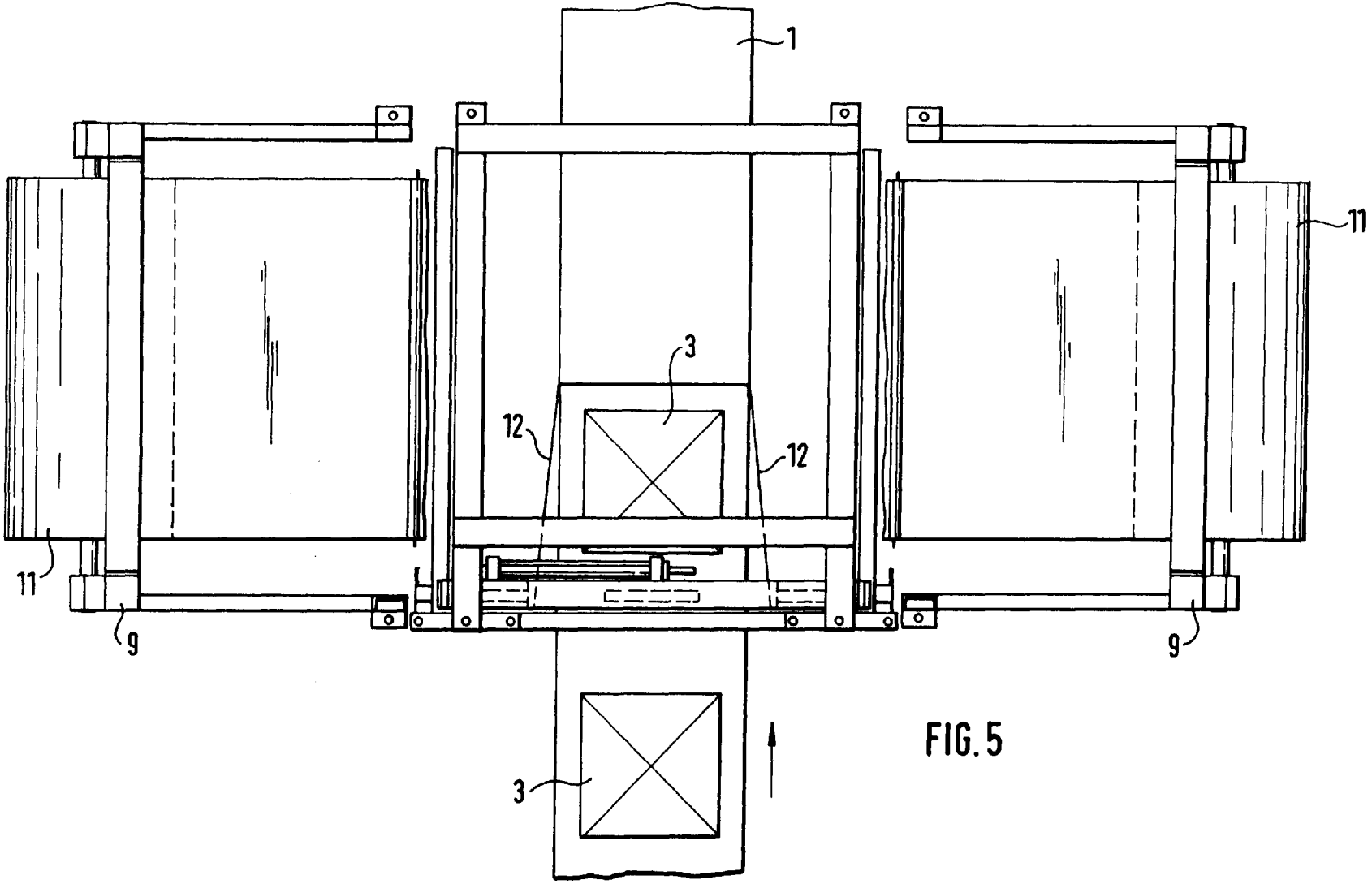
FIG. 5 is a plan view of the subject matter of FIG. 3.
Figure 6:
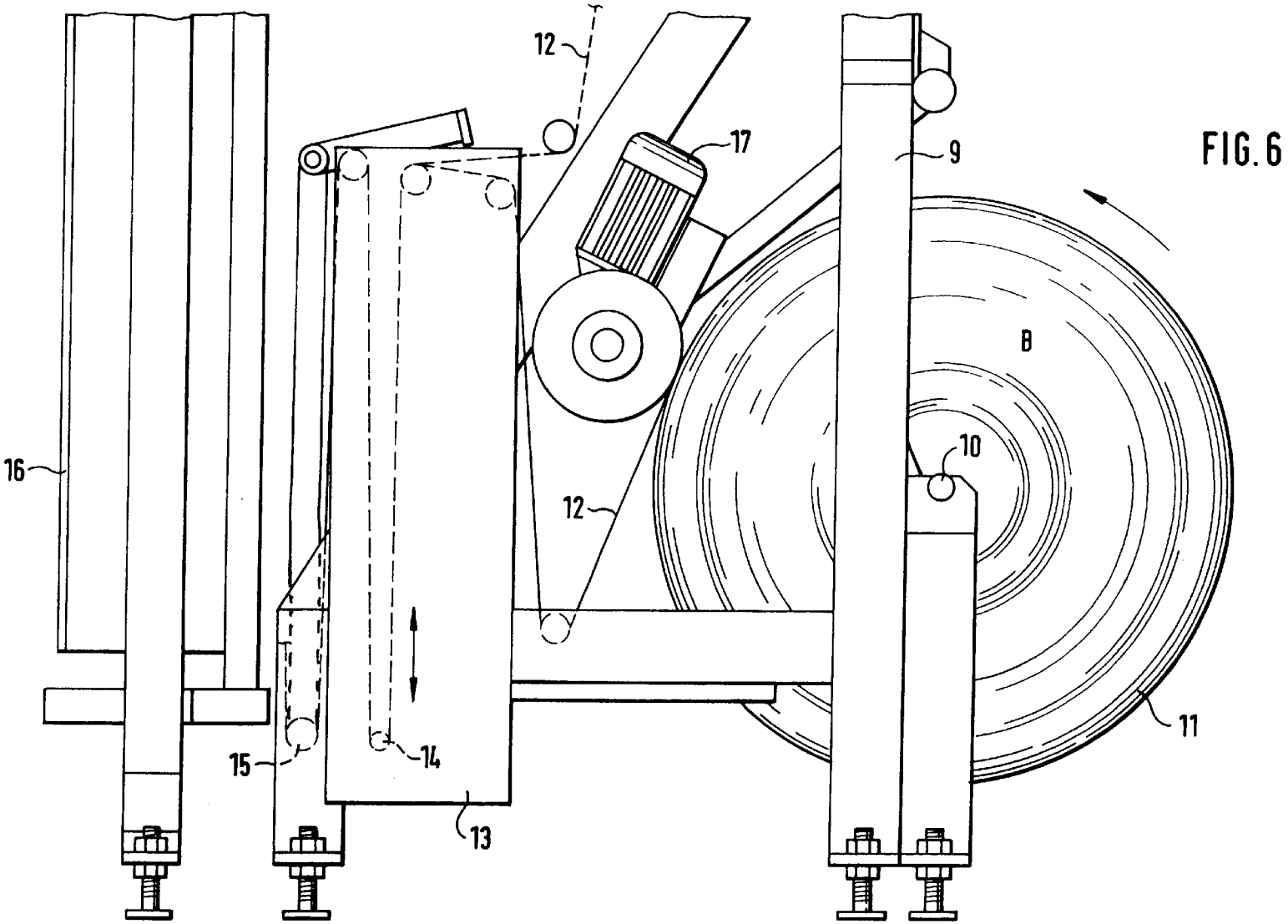
FIG. 6 is a partial view of the subject matter of FIG. 3 in an enlarged detail.
Figure 8:
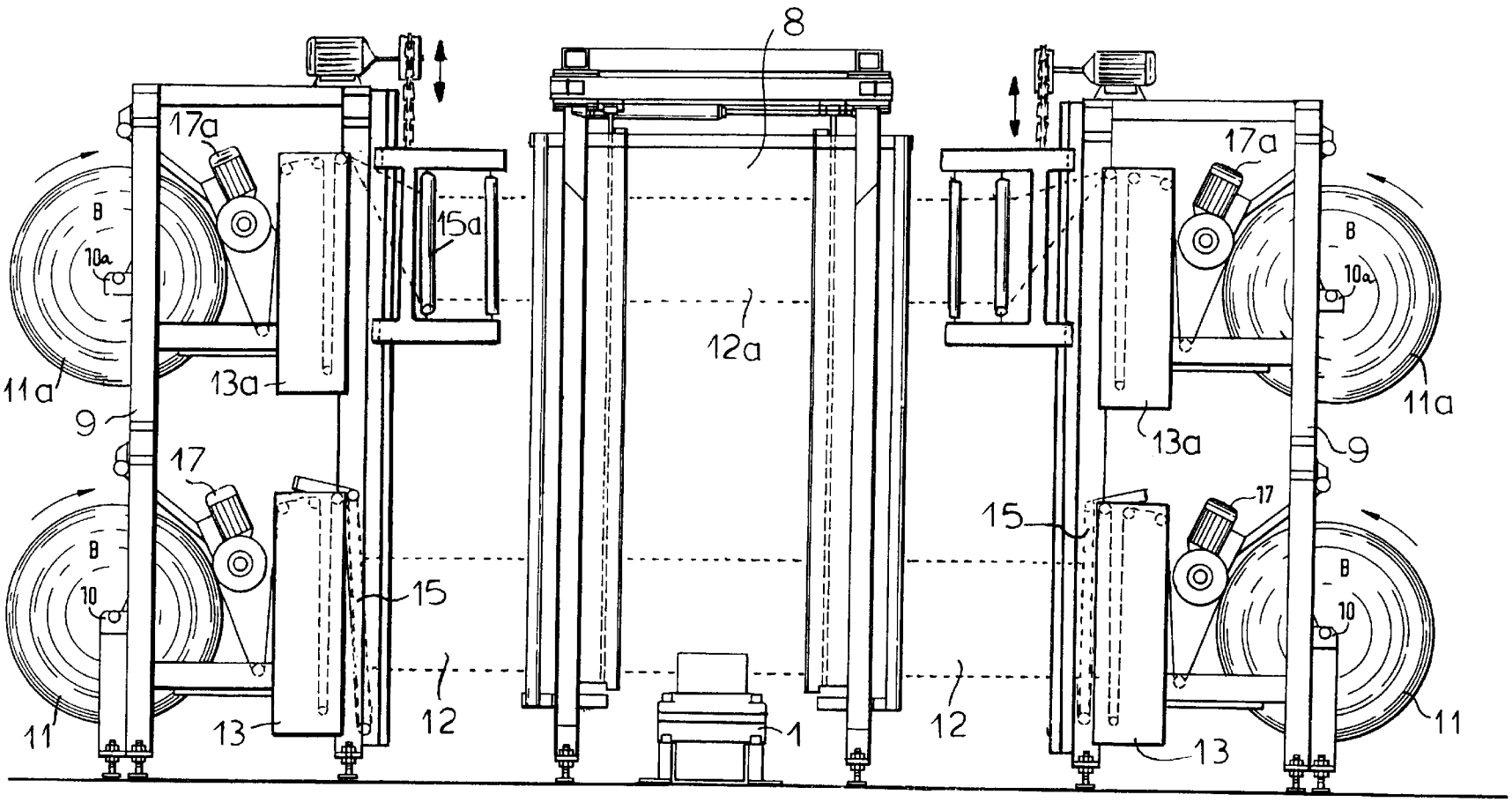
FIG. 8 is the subject matter of FIG. 7 in a front elevational view.

The foil webs 12, 12*a* withdrawn from the shrink-foil rolls 11, 11*a* pass initially through a foil storage 13, 13*a* corresponding to FIGS. 3 and 8, which have at least one dancer roll 14, 14*a* and are guided then respectively over a rerouting device 15, 15*a* which in the configuration illustrated, is comprised of an inclined roller or rail, especially Teflon coated or completely of Teflon, which guides the foil web 12, 12*a* from its horizon orientation into a vertical orientation. In this vertical orientation, the foil webs coming from both sides at 12, 12*a* are connected together in the region of the portal 8 at their respective ends. For this purpose, on both sides of the portal 8, doubled-weld beams 16, 16*a* are disposed which are movable against one another as associated drives.

Each shrink foil roller 11, 11*a* has a friction wheel drive 17, 17*a* engageable with its periphery.

The illustrated apparatus works as follows:

In the portal 8 the foil webs 12, 12*a* form with their ends respectively a shrink-foil curtain. Into the shrink-foil curtain, a stacked-goods unit 3 is fed on the conveyor 1 and entrains the shrink-foil curtain therewith so that the stacked-goods unit 3 is lines on three sides with foil. After the stacked-goods unit 3 is positioned by forward or reverse travel, the two double-weld beams 16, 16*a* arranged on both sides of the conveyor 1 are displaced together and guide the foil webs 12 and 12*a* around the rear fourth side of the stacked-goods unit 3 until they meet approximately in the middle or outside of the middle. There the two foil webs 12, 12*a* are provided with a double-weld seam and are separated by a hot wire not shown in the middle between the double-weld seam, so that for the following stacked-good unit 3 a further shrink-foil curtain is provided.

The friction wheel drives 17, 17*a* of the shrink-foil rolls 11, 11*a* can operate independently of the transport speed of the conveyor 1 and of the cycling rate of the apparatus practically without interruption so that the foil webs 12, 12*a* are fed continuously into the respective foil storages 13, 13*a*. The foil webs in the foil storages 13, 13*a* are withdrawn therefrom as need arises, i.e. when a new stacked goods unit 3 is fed into the portal 8 and thus entrains the shrink-foil curtain there found with that stacked-goods unit 3.

When a shrink-foil roller 11, 11*a* is consumed, initially without replacement of the shrink-foil rolls 11, 11*a*, the other shrink-foil rolls 11, 11*a* are set in operation. One can, however, also provide at each side of the frame 9 shrink-foil rolls 11, 11*a* with different foil widths and thus provides the possibility for a rapid change of foil widths.

Figure 7:
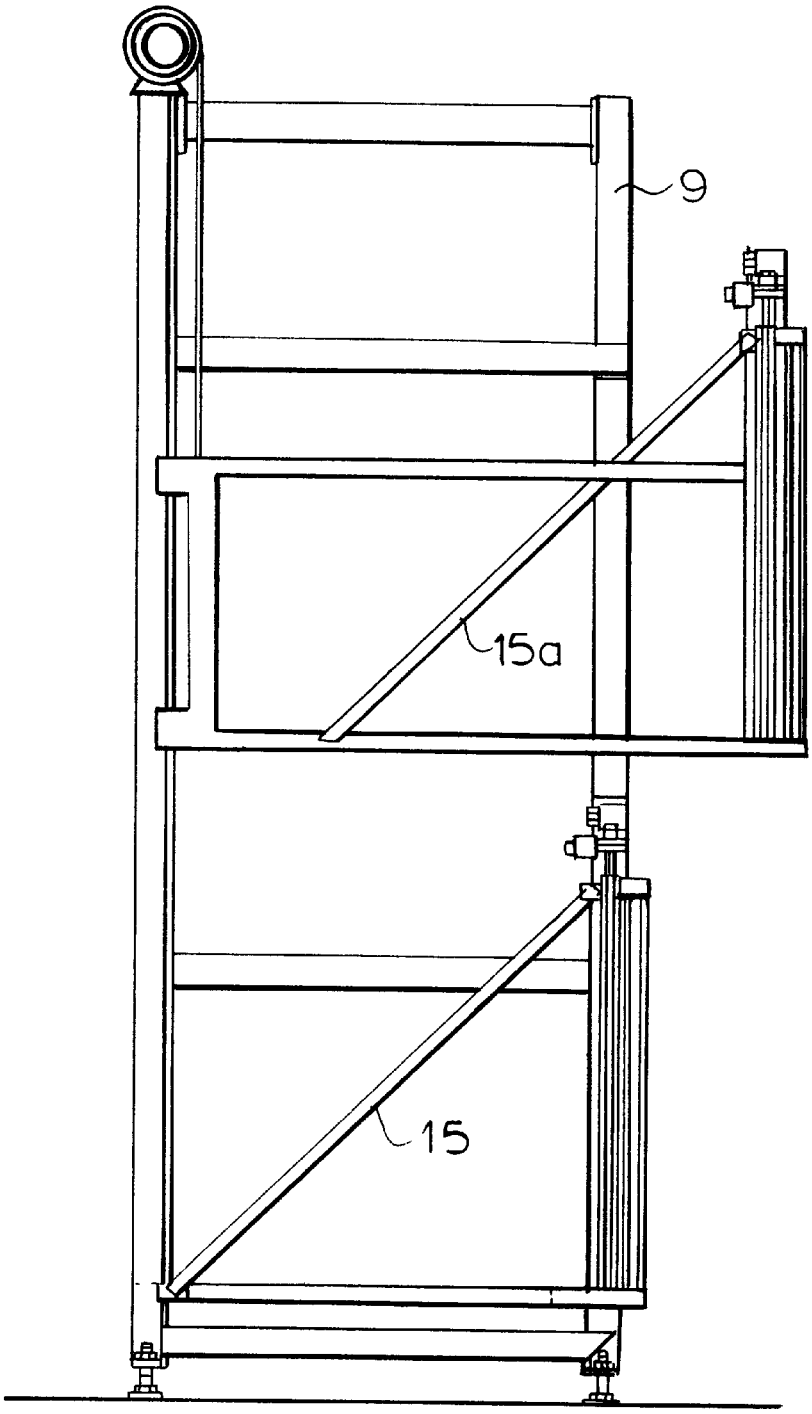
FIG. 7 is a schematic side elevational view of an apparatus for wrapping a stacked-good unit with two shrink-foil wraps whereby the shrink rolls have not been illustrated.
Figure 9:
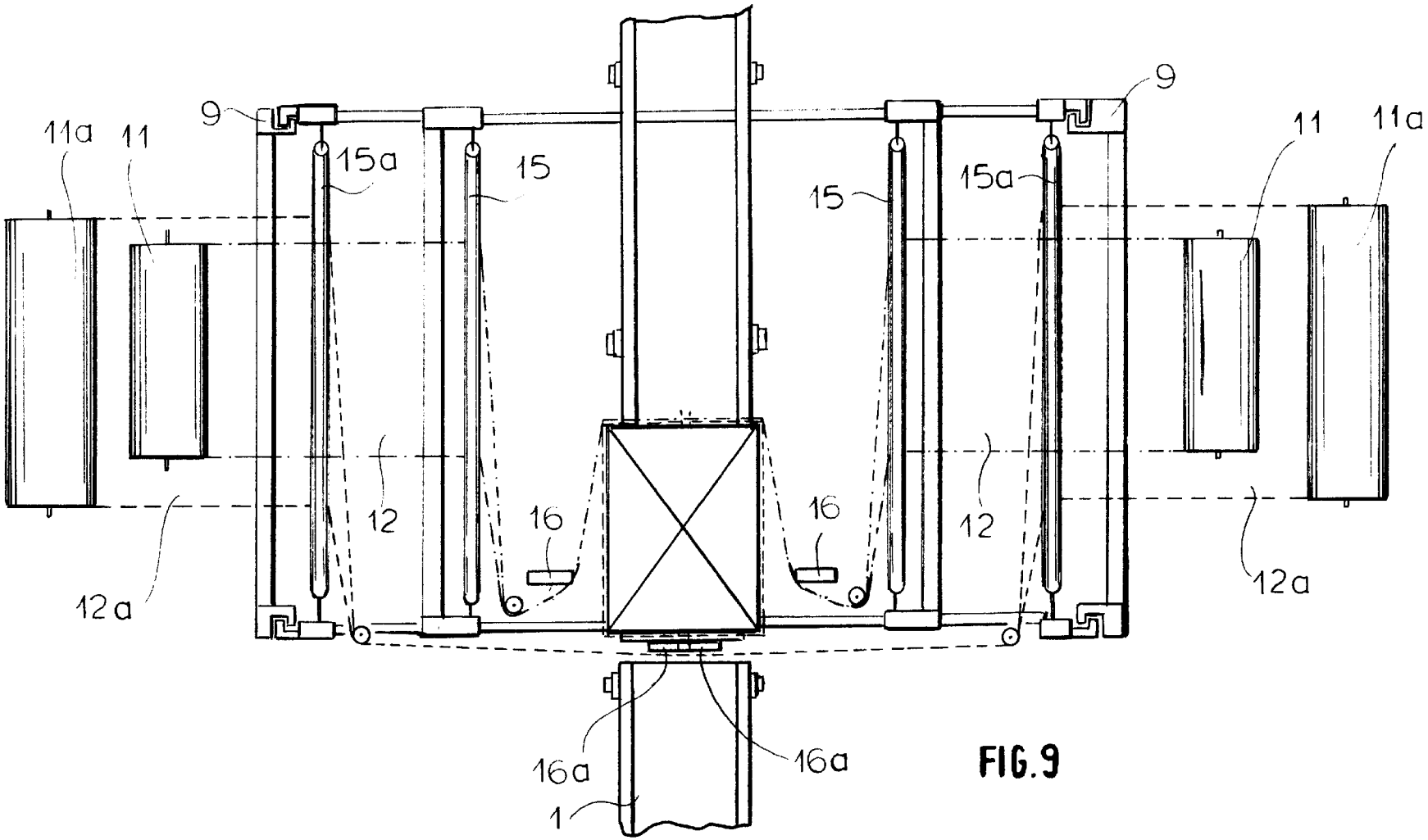
FIG. 9 is a plan view of a further apparatus for wrapping a stacked-good unit with two shrink-foil wraps.

As has been shown in FIGS. 7 through 9, the inactive foil curtain is then guided upwardly. The path difference resulting from the upward movement between the shrink-foil curtain and the shrink-foil curtain roll 11, 11*a* is compensated via the dancer rolls 14, 14*a* in the foil storage 13, 13*a*.

The second shrink foil curtain can, however, be arranged overlappingly with the first shrink-foil curtain when stacked-goods units 3 are to be wrapped which have heights greater than the height of one shrink-foil curtain.

In this case, the rerouting devices 15, 15*a* are displaced into their higher positions whereby the foil storages 13, 13*a* compensates the path change. It is possible to displace only one pair of shrink-foil rollers 11*a* corresponding to FIGS. 7 through 9, although it is also possible to change a plurality of pairs of shrink-foil rollers 11, 11*a* as to their positions.

According to FIG. 8, for the total height of the stacked-goods unit 3 only one pair of double-weld beams 16 is provided for the simultaneous welding of all shrink-foils although the embodiment of FIG. 9 has two pairs of double-weld beams 16, 16*a* which weld the various foil webs 12, 12*a* one after the other.

We claim:

1. An apparatus for shrink wrapping a stacked-goods unit, comprising:

a wrapping station formed with a portal;

a conveyor extending through said portal for carrying a succession of stacked-goods units to be wrapped through said portal;

first mounting means at each side of said portal for holding a respective first roll of a shrink-foil wrap in a horizontal orientation and journaling the respective roll on a respective horizontal axis;

first rerouting means at each side of said portal for drawing a respective first web of shrink-foil wrap from each first roll and orienting the respective first web in a vertical plane;

second mounting means at each side of said portal for holding a respective second roll of shrink-foil wrap in a horizontal orientation and journaling the respective second roll on a respective horizontal axis parallel to the axis of a respective first roll;

second rerouting means at each side of said portal for drawing a respective second web of shrink-foil wrap from each second roll and orienting the respective second web in a vertical plane;

means for driving each of said rolls about the respective axis;

a pair of double-weld beams engaging the webs from said first rerouting means and welding said first webs together to form a shrink-wrap first curtain across said portal ahead of a stacked-goods unit displaced along said conveyor, said double-weld beams drawing said webs together behind the stacked-goods unit to form a seam and produce another first curtain ahead of a successive stacked-goods unit, and for welding said second webs together to form further curtains therefrom across said portal; and means for adjusting the heights of said further curtains.

2. The apparatus defined in claim 1 wherein said second rolls are longer than the first-mentioned rolls and said second curtains are wider than the first-mentioned curtains, said second rolls being disposed outwardly of the first-mentioned rolls at the respective side of the portal.

3. The apparatus defined in claim 1 wherein each of said mounting means includes bearings for shafts carrying the respective rolls and extending generally transversely to the portal.

4. The apparatus defined in claim 1 wherein a plurality of said rolls are arranged on each side of the portal, one above another.

5. The apparatus defined in claim 1 wherein said means for driving includes a friction wheel bearing upon the respective roll.

6. The apparatus defined in claim 1 wherein each of said rerouting means includes a foil storage unit.

7. The apparatus defined in claim 6 wherein each foil storage unit includes at least one dancer roller around which the respective web is looped.

8. An apparatus for shrink wrapping a stacked-goods unit, comprising:

a wrapping station formed with a portal;

a conveyor extending through said portal for carrying a succession of stacked-goods units to be wrapped through said portal;

first mounting means at each side of said portal for holding a respective first roll of a shrink-foil wrap in a horizontal orientation and journaling the respective roll on a respective horizontal axis;

first rerouting means at each side of said portal for drawing a respective first web of shrink-foil wrap from each first roll and orienting the respective first web in a vertical plane;

second mounting means at each side of said portal for holding a respective second roll of shrink-foil wrap in a horizontal orientation and journaling the respective second roll on a respective horizontal axis parallel to the axis of a respective first roll;

second rerouting means at each side of said portal for drawing a respective second web of shrink-foil wrap from each second roll and orienting the respective second web in a vertical plane; and means for driving each of said rolls about the respective axis;

a pair of double-weld beams engaging the webs from said first rerouting means and welding said first webs together to form a shrink-wrap first curtain across said portal ahead of a stacked-goods unit displaced along said conveyor, said double-weld beams drawing said webs together behind the stacked-goods unit to form a seam and produce another first curtain ahead of a successive stacked-goods unit, and for welding said second webs together to form further curtains therefrom across said portal, said second rerouting means being arranged to enable said further curtains to be swung upwardly relative to said first curtains.

9. The apparatus defined in claim 8 wherein said second rolls are longer than the first-mentioned rolls and said second curtains are wider than the first-mentioned curtains, said second rolls being disposed outwardly of the first-mentioned rolls at the respective side of the portal.

10. The apparatus defined in claim 8 wherein each of said mounting means includes bearings for shafts carrying the respective rolls and extending generally transversely to the portal.

11. The apparatus defined in claim 8 wherein a plurality of said rolls are arranged on each side of the portal, one above another.

12. The apparatus defined in claim 8 wherein said means for driving includes a friction wheel bearing upon the respective roll.

13. The apparatus defined in claim 8 wherein each of said rerouting means includes a foil storage unit.

14. The apparatus defined in claim 13 wherein each foil storage unit includes at least one dancer roller around which the respective web is looped.

* * * * *